US006455110B1

(12) United States Patent
Fortuyn et al.

(10) Patent No.: US 6,455,110 B1
(45) **Date of Patent: *Sep. 24, 2002**

(54) ELECTROSTATIC POWDER COATING ON NON-CONDUCTIVE PLASTICS

(75) Inventors: Johannes E. Fortuyn, Bergen op Zoom (NL); Gerd Claus Hochberg, Russelsheim (DE); Ron Van Hoorn, Tholen (NL); Christiaan Henricus Koevoets, Rosendaal (NL); Jan Wagenaar, Bergen op Zoom (NL)

(73) Assignee: General Electric Company, Pittsfield, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/568,995

(22) Filed: May 11, 2000

(51) Int. Cl.[7] ..... B05D 1/04
(52) U.S. Cl. ..... 427/475; 427/485; 428/474.4
(58) Field of Search ..... 427/471, 475, 427/477, 479, 480, 485; 156/230, 232, 233; 361/225–227; 428/474.4

(56) References Cited

U.S. PATENT DOCUMENTS

| | | | | |
|---|---|---|---|---|
| 3,741,793 A | | 6/1973 | Simmons | 117/93.4 |
| 4,085,163 A | * | 4/1978 | Gergen et al. | |
| 5,262,207 A | * | 11/1993 | Garner et al. | |
| 5,490,893 A | | 2/1996 | Enlow et al. | |
| 5,518,786 A | | 5/1996 | Johnson et al. | |
| 5,997,959 A | * | 12/1999 | Lebioda | |

FOREIGN PATENT DOCUMENTS

| | | | |
|---|---|---|---|
| DE | 197 53 602 A1 | | 10/1999 |
| EP | 0 534 512 A1 | | 8/1992 |
| GB | 956564 | | 6/1960 |
| GB | 1 285 551 | | 5/1969 |
| JP | 4-71665 | * | 3/1992 |

OTHER PUBLICATIONS

Bouguila, et al. "Peinture Electrostatique Des Surfaces Isolantes" Revue Generale De L'Electricite, Rge/ Paris, FR No. 8 (Sep. 9, 1991). pp. 25–28.

Elmoursi et al. "Electrostatic Painting of Plastics Using Metal Backing" Proceddings of the Industry App;lcations Society Annual Meeting. Houston, Oct. 4–9, 1992, New York, IEEE, US vol. 2 pp. 1506–1512.

* cited by examiner

*Primary Examiner*—Fred J. Parker

(57) ABSTRACT

A method for electrostatic painting (coating) of a non-conductive compatibilized poly(arylene ether)/polyamide polymer surface is disclosed, comprising applying a conductive layer on or adjacent to all or part of a side opposite the non-conductive polymer surface to be painted so as to provide sufficient conductivity to enable electrostatic painting of the non-conductive polymer surface. With the conductive layer in place the article can then be painted electrostatically. After painting, the conductive layer can optionally be removed without affecting the painted surface.

28 Claims, No Drawings

ELECTROSTATIC POWDER COATING ON NON-CONDUCTIVE PLASTICS

TECHNICAL FIELD

This application pertains to the electrostatic painting, and in particular to the electrostatic painting of non-conductive plastics.

BACKGROUND OF THE INVENTION

In recent years, the automotive industry has increased its use of plastic materials for exterior car body panels and trim parts. The predominant reasons are weight-reduction and the availability of more sophisticated high impact strength plastics, such as Noryl GTX® resin, a poly(arylene ether)/polyamide composition. To a large extent, the future success of plastics for car body panels will depend on their ability to be painted "on-line" in the assembly plant with a high quality appearance similar to painted metal car body panels.

When a metal body panel is painted, it is relatively simple to maintain the metal at ground potential. In the electrostatic painting process, particles (paint droplets) are charged by an electrode in the spray head, and a charged spray cloud from the spray head is attracted to the metal surface by the high voltage difference. This process greatly reduces over-spray and produces a high quality surface on the painted metal parts. For these reasons, and others, electrostatic spray painting techniques are the methods of choice in the automotive industry for spray painting exterior body panels made of sheet metal.

Difficulties arise when using electrostatic spray techniques for painting plastic substrates. The problem is particularly difficult when the objective is to paint plastics with the same high quality and appearance as metal parts using electrostatic paint spray equipment. In order to electrostatically spray paint plastic substrates, a number of technical problems must be overcome. For instance, electrostatic charges accumulate on the surface of a plastic substrate during the electrostatic spray painting process. The charges that accumulate do not dissipate as readily as with metals. This accumulation of charges reduces the potential between the spray head and the substrate, leading to weaker electrical forces on the charged paint droplets. The accumulated charges on the substrate surface also cause an opposing electrical field that repels air-borne paint particles, and tend to produce a non-uniform field across the surface. These phenomena produce a self-limiting effect of yielding less paint deposition and producing less uniformity in the build-up of the paint film when compared with painting metal substrates. In addition, some plastics have retained charges that may continue to exist for long time periods after the paint has been sprayed, making the painted surface more vulnerable to dust attraction. As a result of these problems, it has been difficult to achieve a high quality paint coat by electrostatic painting of plastics. The problem is particularly difficult when the objective is to apply uniform paint coats to plastic panels having complex three-dimensional shapes.

Conductive plastic substrate materials comprised of plastic and conductive filler, can be painted by electrostatic spray techniques. The conductive filler alleviates the build up of surface charges and the resulting low deposition and non-uniform build up of paint films on plastics. Conductive plastic substrates do have drawbacks however. The base color is typically black and hence it is difficult to achieve good paint coverage, especially with light colors. More significant, however, is that many conductive fillers diminish the desirable physical properties, such as ductility, of the finished part.

Another approach has been to develop electrically conductive primers which are air-sprayed onto the plastic substrate prior to electrostatically spraying on the finished paint film. Conductive primers can reduce the problems of accumulated electrostatic charges, low paint film build-up and non-uniform conductivity and film thickness, but in order to effectively use such conductive primers, certain technical problems first must be overcome. Such problems have been controlling the surface smoothness of the primer and achieving good adhesion to the polymer. The conductive primer needs a good level of surface conductivity along with humidity insensitivity, uniformity of conductivity across the primer surface, and durability. If surface conductivity is too low, non-uniform build-up of the paint film can result. Surface conductivity, as measured in terms of "resistivity" (ohms), should be reasonably insensitive to humidity; otherwise non-uniformities in conductivity and in the paint film build-up are produced. Coating thickness can alter the uniformity of surface conductivity. When coating thickness varies as the primer is applied it is difficult to achieve uniform surface conductivity.

Generally speaking, the use of conductive primers for plastic substrate panels in the automotive industry has not been successful in economically producing a high quality finish. Because of non-uniform conductivity and primer film thickness, this priming technique has resulted in a generally poor appearance of the finished paint film. A non-uniform primer, even though an undercoat in the process, can cause a poor appearance of the finished exterior paint coat. It is difficult to produce a uniform paint film thickness with a primer applied by non-electrostatic air spray techniques, followed by air spraying a charged-particle paint film.

As a result of the above mentioned problems, the technique of using conductive primers has resulted in a high scrap rate and increased production time. The current method of priming plastic parts for electrostatic paint spraying involves the additional step of either shipping to a separate location for priming, or priming on the paint line at the assembly plant. This amounts to high transportation and handling costs and a higher than normal scrap return rate.

U.S. Pat. No. 5,490,893, to Enlow et al., herein included by reference, discloses the use of a thermoformable conductive laminate to provide a conductive, paintable surface to the non-conductive surface and thereby overcome the problems of non-uniform conductivity and primer thickness. Enlow et al. form a matte release-coated casting sheet, then cast a thin film of an electrically conductive polymer so as to form a conductive primer coat. The conductive primer coat is transfer-laminated to a thermoformable plastic sheet to form a conductive face sheet which is thermoformed and bonded to the plastic substrate article. The article is then painted by applying the paint to the electrostatically paintable conductive face sheet. Paint is not applied to the non-conductive surface but to the conductive face sheet covering the non-conductive surface. Although Enlow et al. solve some problems, the dark base color of the thermoformable conductive laminate as well as the large number of steps in the process make this process uneconomical. Dark base colors generally make it difficult to obtain good paint coverage, especially with light colors. These disadvantages are compounded by the fact that a dark base color will easily show through when the paint layer is damaged such as when the article is scratched.

Accordingly, there remains a need in the art for a means to economically provide conductivity to non-conductive polymer surfaces with uniform conductivity and non-dark base color for electrostatic painting.

BRIEF SUMMARY OF THE INVENTION

The present invention relates to a method for painting a non-conductive polymer article. The method comprises applying a conductive layer, such as a metal foil, adjacent to at least a portion of a second surface of the article so as to provide sufficient conductivity to enable electrostatic painting of a first surface of the article, and electrostatically painting the first surface.

The above discussed and other features and advantages of the present invention will be appreciated and understood by those skilled in the art from the following detailed description.

DETAILED DESCRIPTION OF THE INVENTION

The above described drawbacks and deficiencies in the prior art are overcome by the invention of a method for electrostatic painting (coating) of a non-conductive polymer surface comprising applying a conductive layer on or adjacent to all or part of a side opposite the non-conductive polymer surface to be painted so as to provide sufficient conductivity to enable electrostatic painting of the non-conductive polymer surface. With the conductive layer in place the article can then be painted electrostatically. After painting, the conductive layer can optionally be removed without affecting the painted surface.

Unexpectedly it was found that when one side of a non-conductive part or layer ("inner surface") is brought fully or partially in contact with or disposed sufficiently close to a conductive layer, the opposite surface ("outer side") becomes sufficiently conductive to be electrostatically paintable. Additionally, surfaces adjacent to the conductive layer can become sufficiently conductive to be electrostatically paintable. The non-conductive layer can have any thickness such that the surface of the non-conductive layer becomes sufficiently conductive to be electrostatically paintable. Thicknesses up to about 4 millimeters (mm) are typical, with a thickness of about 3 mm or less preferred, and about 2 mm or less especially preferred. It was also unexpectedly found that the conductive layer and the non-conductive layer do not have to be in full contact. Consequentially, the conductive layer is preferentially oriented, in relation to the non-conductive layer to be painted, sufficiently close and/or in physical contact to impart sufficient conductivity to the non-conductive layer to enable electrostatic painting thereof. Sufficient conductivity is defined as having a resistivity of about $1\times10^5$ ohm or less. It is typically sufficient for the conductive layer and non-conductive layer to be a distance of up to about 1.5 mm apart, with a distance of about 1 mm or less preferred, and direct physical contact between the non-conductive and conductive layers over at least a portion of the inner surface more preferred, and direct physical contact over substantially most of the inner surface especially preferred.

In addition to not requiring direct physical contact, the conductive layer does not need to be continuous. Small gaps and holes in the conductive layer up to about 5 $mm^2$ or so in size do not affect the paint result, with smaller or no holes preferred. As with the proximity of the conductive layer to the non-conductive layer, the desired continuity of the conductive layer is based upon attaining the desired conductivity (e.g., resistivity about $1\times10^5$ ohm or less) substantially uniformly across the non-conductive layer.

Several kinds of conductive layers are useful, with conductive layers having a resistivity of about 200 ohms or less preferred, with those having a resistivity of about 40 ohms or less more preferred, and those having a resistivity of about 1 ohm or less especially preferred. Examples of useful conductive layers include metal foils, metal film laminates, metal wool, metal brushes and metal net, and the like, and combinations comprising at least one of the foregoing. Metal foil is defined as a sheet of metal with a thickness of about 300 microns or less. Metal foils and metal film laminates are preferred due to their ease in handling as well as low cost. Preferred metal film laminates include polyethylene/aluminum laminates and polyester/aluminum laminates with an aluminum thickness of about 4 microns or greater generally preferred. Especially useful polyesters include poly(butylene terephthalate) resin, for example, VALOX® resins available from GE Plastics, Pittsfield, Mass. Metal foils, such as aluminum foil, with a thickness sufficient to enable handling of the foil but sufficiently thin to be cost effective, e.g. about 5 microns to about 300 microns, are useful, with a thickness about 10 microns to about 100 microns preferred.

Useful non-conductive layers are those capable of attaining sufficient conductivity to enable electrostatic painting. Some useful materials include polymers and polymer blends with amide groups. Preferred materials are polyamide or polyamide blends such as compatibilized poly(arylene ether)/polyamide compositions (hereinafter PAE/PA). Polyamide and polyamide blends are well known in the art and are commercially available. Useful polyamide blends comprise at least about 10 weight percent polyamide. Quite unexpectedly it was found, as seen in the Examples below, only polymers containing polyamide were successfully electrostatically painted when the thickness of the conductive layer was about 16 micron or less.

In a first embodiment the conductive layer is brought fully or partially in contact with or disposed sufficiently close to a non-conductive layer. It is preferred for the conductive layer to be a foil or metal film laminate applied to the non-conductive layer. An adhesive may be used to maintain close proximity between the conductive and non-conductive layers. After the non-conductive layer is electrostatically painted the conductive layer may be removed or left in place.

In a second embodiment, the conductive/non-conductive layer system can comprise 2K molded conductive thermoplastic layers. 2K molding is a technique for producing an article with multiple layers of two or more different materials (e.g., two or three layers of two different materials). 2K molding can therefore produce an article with either a conductive layer and a non-conductive layer or a conductive layer sandwiched between two non-conductive layers. The non-conductive layer(s) will hereinafter be referred to as the skin and the conductive layer will be referred to as the core. Useful materials for the core include any injection moldable material with resistivity of about 200 ohms or less preferred and those having a resistivity of about 40 ohms or less more preferred and those having a resistivity of about 1 ohm or less especially preferred. A preferred core material is a conductive PAE/PA. Especially useful as the core material is a conductive PAE/PA such as Noryl GTX® VP081 resin, available from GE Plastics. Useful skin materials are injection moldable materials capable of attaining sufficient conductivity to enable electrostatic painting. Preferred materials are polyamide and PAE/PA as described in the first embodiment. Especially preferred are Noryl GTX 944 and Noryl GTX 964 resins, PAE/PA's with different viscosities available from GE Plastics.

The juxtaposition of the conductive layer (core) adjacent to the non-conductive layer in 2K molding allows the non-conductive layer (the skin) to be electrostatically painted. Two advantages of 2K molding are the desirable physical properties of the non-conductive layer such as ductility are maintained and the conductive layer is provided in the same step as the molding of the article. 2K molding is especially useful in articles which must be painted on more than one side. With the conductive layer within the article, all sides can be electrostatically painted without repeated conductive layer applications.

The non-conductive layer can be comprised of any polymer composition which can attain the desired conductivity when disposed next to or in physical contact with a conductive layer. Some useful materials include polymers,and polymer blends with amide groups, notably polyamide, poly(arylene ether)/polyamide compositions and the like. Noryl GTX 944 and Noryl GTX 964 resins, PAE/PA's available from GE Plastics, are particularly useful.

Once the non-conductive polymer is formed into an article by any conventional technique and the conductive layer is disposed on or adjacent to one or more surfaces so as to provide sufficient conductivity to enable electrostatic painting of the opposite surface(s). Once the opposite surface has been painted electrostatically, the conductive layer can be removed. For example, aluminum foil, preferably with a thickness greater than about 5 microns, is applied on or adjacent to the inner surface of an article made of non-conductive PAE/PA. The article is then painted electrostatically and the foil is removed after painting is complete.

The method of the invention is further demonstrated by the following examples which are meant to be illustrative, not limiting.

EXAMPLES

Materials used in the following examples are listed in Table 1.

TABLE 1

| Material Name | Type of Polymer Resin | Supplier |
|---|---|---|
| Noryl GTX 944 resin | PAE/PA | GE Plastics |
| Noryl GTX 964 resin | PAE/PA | GE Plastics |
| Noryl HINI 20P resin | Poly(arylene ether)/polystyrene (hereinafter PAE/PS) | GE Plastics |
| Xenoy 1466D | Polycarbonate/poly(butylene terephthalate) (hereinafter PC/PBT) | GE Plastics |
| Valox 8023 resin | PoIy(butylene terephthalate) (hereinafter PBT) | GE Plastics |
| Lexan LS2 resin | Polycarbonate (hereinafter PC) | GE Plastics |
| Cycoloy C1200 resin | Polycarbonate/poly(acrylonitrile-butadiene-styrene) (hereinafter PC/ABS)) | GE Plastics |
| Cycolac TCA resin | Poly(acrylonitrile-butadiene-styrene) (hereinafter ABS) | GE Plastics |

Noryl, Noryl GTX, Xenoy, Lexan, Cycoloy, and Cycolac are registered trademarks of General Electric Company.

Examples 1–8

Plaques, 2–3 mm thick, were molded from a chosen polymer. Half of one side of each plaque was covered with aluminum foil (16 micron ($\mu$) thickness). The uncovered side of each plaque was a control. The plaques were then electrostatically painted. Non-conductive layer composition and painting results are shown in Table 2. A painting result of possible demonstrates a surface finish acceptable in the automotive industry. A painting result of not possible indicates an unacceptable level of surface defects.

TABLE 2

| Example | Polymer material | Painting Result |
|---|---|---|
| 1 | Noryl GTX 944 resin | Possible |
| 2 | Noryl GTX 964 resin | Possible |
| 3 | Noryl HINI 20P resin | Not Possible |
| 4 | Xenoy 1466D | Not Possible |
| 5 | Valox 8023 resin | Not Possible |
| 6 | Lexan LS2 resin | Not Possible |
| 7 | Cycoloy C1200 resin | Not Possible |
| 8 | Cycolac TCA resin | Not Possible |

Examples 9–12

Plaques made of Noryl GTX 964 or 944 resin were covered on the backside with different conductive layers. Results of the painting trials are in Table 3.

TABLE 3

| Example | Polymer material | Conductive layer | Resistivity | Painting result |
|---|---|---|---|---|
| 9 | Noryl GTX 944 resin | Polyethylene film + 0.3$\mu$ Al | — | Not possible |
| 10 | Noryl GTX 944 resin | Polyethylene film + 4$\mu$ Al | 200 ohm | Marginal |
| 11 | Noryl GTX 944 resin | Polyethylene film + 12$\mu$ Al | 40 ohm | Possible |
| 12 | Noryl GTX 944 resin | 16$\mu$ Al | less than 1 ohm | Possible |
| 13 | Noryl GTX 944 resin | Valox resin + 35$\mu$ Al | less than 1 ohm | Possible |
| 14 | Noryl GTX 964 resin | Polyethylene film + 0.3$\mu$ Al | — | Not possible |
| 15 | Noryl GTX 964 resin | Polyethylene film + 4$\mu$ Al | 200 ohm | Marginal |
| 16 | Noryl GTX 964 resin | Polyethylene film + 12$\mu$ Al | 40 ohm | Possible |
| 17 | Noryl GTX 964 resin | 16$\mu$ Al | less than 1 ohm | Possible |
| 18 | Noryl GTX 964 resin | Valox resin + 35$\mu$ Al | less than 1 ohm | Possible |

Examples 18–25

Plaques made of PAE/PA (Noryl GTX 964 or 944 resins) were put adjacent to a solid metal plate with varying distances between the metal plate and plaque. The plaques were then painted electrostatically. Results are shown in Table 4. Painting results were the same regardless of the variation PAE/PA used demonstrating the wide utility of the present invention.

TABLE 4

| Example | Distance (mm) | Material | Painting result |
|---|---|---|---|
| 18 | 0 (direct contact) | Noryl GTX 964 resin | Possible |
| 19 | 0.8 | Noryl GTX 964 resin | Possible |
| 20 | 1 | Noryl GTX 964 resin | Possible |
| 21 | 1.6 | Noryl GTX 964 resin | Not possible |

TABLE 4-continued

| Example | Distance (mm) | Material | Painting result |
|---|---|---|---|
| 23 | 2 | Noryl GTX 964 resin | Not possible |
| 24 | 2.5 | Noryl GTX 964 resin | Not possible |
| 25 | greater than 10 | Noryl GTX 964 resin | Not possible |
| 26 | 0 (direct contact) | Noryl GTX 944 resin | Possible |
| 27 | 0.8 | Noryl GTX 944 resin | Possible |
| 28 | 1 | Noryl GTX 944 resin | Possible |
| 29 | 1.6 | Noryl GTX 944 resin | Not possible |
| 30 | 2 | Noryl GTX 944 resin | Not possible |
| 31 | 2.5 | Noryl GTX 944 resin | Not possible |
| 32 | greater than 10 | Noryl GTX 944 resin | Not possible |

Examples 33–37

PAE (both Noryl GTX 964 and 944 resins) outer layers were 2K molded with a conductive PAE/PA (Noryl GTX VP081 resin) core into plaques. Plaques were also molded of each of the non-conductive PAE/PA materials as controls (single layer examples). The plaques were electrostatically painted. In the two layer examples, the conductive PAE/PA did not form a completed layer throughout the plaque, particularly near the edges. Even with gaps of 3–5 mm of the conductive material from the edge, good paint coverage resulted. Results are shown in Table 5.

TABLE 5

| Example | Core material | Skin material | Painting Result |
|---|---|---|---|
| 33 | Noryl GTX VPO81 resin | Noryl GTX 944 resin | Possible |
| 34 | Noryl GTX VPO81 resin | Noryl GTX 964 resin | Possible |
| 35 | Noryl GTX VPO8I* resin | — | Possible |
| 36 | Noryl GTX 944* resin | — | Not Possible |
| 37 | Noryl GTX 964* resin | — | Not Possible |

*These control examples are outside the scope of the invention

As can be seen by the foregoing examples electrostatic painting of non-conductive polymers is made feasible by the employment of a relatively thin conductive layer on the side of the non-conductive layer opposite the side to be painted. This conductive layer can be wholly or partially in physical contact with the nonconductive layer, or disposed up to about 1.5 mm away from the non-conductive layer. There are a variety of useful conductive layers ranging from a thin, conductive metal film laminate to a metal foil or net, to a 2K molded conductive layer.

It is remarkable to note in the examples utilizing conductive metal film laminates successful electrostatic painting was achieved with very small amounts of metal. Metal thicknesses as small as $4\mu$ in a metal film laminate provided sufficient conductivity to the poly(arylene ether)/polyamide blend for painting. It is equally remarkable that with a conductive layer thickness of $16\mu$ electrostatic painting of several other polymers and polymer blends such as polycarbonate, poly(arylene ether)polystyrene and polycarbonate/poly(acrylonitrile-butadiene-styrene), was unsuccessful. Articles made from compositions containing polyamide resin, e.g., PAE/PA, can thus be electrostatically painted economically with a minimal amount of metal and if the conductive layer is left in place after painting, a minimal amount of additional weight.

Thus, the method of providing conductivity to non-conductive polymers for electrostatic painting provides a distinct improvement over previous methods of painting. The use of a conductive layer eliminates the problem of electrostatic charge build up that currently plagues electrostatic painting of non-conductive polymers without primers. The use of a conductive layer overcomes the difficulties of employing a conductive primer including adhesion of the primer to the polymer, uniform conductivity and primer thickness, as well as base color. The use of a conductive layer eliminates dark base color problems because the side being painted is the readily paintable natural color of the non-conductive polymer. Furthermore, the non-conductive layer retains all its desirable properties, especially ductility. Ductility is usually reduced when non-conductive material is combined with conductive fillers.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A method for painting a non-conductive polymer article, comprising:

disposing a conductive layer adjacent to at least a portion of a second surface of the article so as to provide sufficient conductivity to enable electrostatic painting of a first surface of the article, said conductive layer having a thickness of about 300 microns to about 5 microns, wherein the non-conductive polymer article comprises a compatibilized poly(arylene ether)/polyamide composition; and electrostatically painting the first surface.

2. The method of claim 1, wherein the conductive layer is a conductive metal.

3. The method of claim 2, wherein the metal is aluminum.

4. The method of claim 3, wherein the conductive layer is about 10 microns to about 100 microns thick.

5. The method of claim 1, wherein the conductive layer has a resistivity of less than about 200 ohms.

6. The method of claim 5, wherein the conductive layer has a resistivity of about 40 ohms or less.

7. The method of claims 6, wherein the conductive layer has a resistivity of about 1 ohm or less.

8. The method of claim 1, wherein the conductive layer is disposed less than about 1.5 mm from the second surface.

9. The method of claim 8, wherein at least a portion of the conductive layer is in direct physical contact with the second surface.

10. The method of claim 1, wherein the conductive layer has gaps less than about 5 $mm^2$ in size.

11. The method of claim 1, wherein the second surface has a resistivity less than $1\times10^5$ ohms.

12. The method of claim 1, further comprising removing the conductive layer after painting.

13. The method of claim 1, wherein the conductive layer is a conductive metal film laminate comprising a metal layer and a substrate layer.

14. The method of claim 13, wherein the metal layer comprises aluminum.

15. The method of claim 13, wherein the substrate layer is a polyethylene, a polyester, or combinations comprising at least one of the foregoing.

16. The article produced by the method of claim 1.

17. A method for painting a non-conductive polymer article comprising:

producing an article having at least a first non-conductive layer disposed adjacent to a conductive layer, wherein the conductive layer provides sufficient conductivity to the first non-conductive layer to enable electrostatic painting of a surface of the first non-conductive layer, wherein the first non-conductive layer comprises a compatibilized poly(arylene ether)/polyamide composition; and electrostatically painting a surface of the first non-conductive layer.

18. The method of claim 17, wherein the conductive layer comprises an injection moldable conductive material.

19. The method of claim 17, wherein the conductive layer has a resistivity of about 200 ohms or less.

20. The method of claim 17, wherein the conductive layer has a resistivity of about 40 ohms or less.

21. The method of claim 17, wherein the conductive layer has a resistivity of about 1 ohm or less.

22. The method of claim 17, wherein the conductive layer has gaps less than about 5 $mm^2$ in size.

23. The method of claim 17, wherein a surface of the first non-conductive layer, opposite the conductive layer, has a resistivity of about $1\times10^5$ ohms or less.

24. The method of claim 17, further comprising a second non-conductive layer disposed adjacent a side of the conductive layer opposite said first non-conductive layer.

25. The method of claim 17, wherein the first non-conductive layer and the conductive layer are molded together.

26. The method of claim 17, wherein the first non-conductive layer and the conductive layer are bonded together.

27. The method of claim 17, wherein the conductive layer comprises a conductive, compatibilized poly(arylene ether)/polyamide blend.

28. The article produced by the method of claim 17.

* * * * *